US008910495B2

(12) United States Patent
Mak

(10) Patent No.: US 8,910,495 B2
(45) Date of Patent: Dec. 16, 2014

(54) CONFIGURATIONS AND METHODS FOR RETROFITTING AN NGL RECOVERY PLANT

(75) Inventor: John Mak, Santa Ana, CA (US)

(73) Assignee: Fluor Technologies Corporation, Aliso Viejo, CA (US)

( * ) Notice: Subject to any disclaimer, the term of this patent is extended or adjusted under 35 U.S.C. 154(b) by 180 days.

(21) Appl. No.: 13/528,332

(22) Filed: Jun. 20, 2012

(65) Prior Publication Data

US 2013/0014390 A1 Jan. 17, 2013

Related U.S. Application Data

(60) Provisional application No. 61/499,033, filed on Jun. 20, 2011.

(51) Int. Cl.

| | |
|---|---|
| ***F25J 3/00*** | (2006.01) |
| ***C10L 3/10*** | (2006.01) |
| ***F25J 3/02*** | (2006.01) |
| ***C10G 5/06*** | (2006.01) |
| ***C10L 3/12*** | (2006.01) |
| ***C10G 5/04*** | (2006.01) |

(52) U.S. Cl.

CPC ..... *F25J 3/0238* (2013.01); *C10L 3/10* (2013.01); *F25J 2200/40* (2013.01); *F25J 3/0295* (2013.01); *F25J 2200/76* (2013.01); *F25J 2210/06* (2013.01); *F25J 2290/80* (2013.01); *F25J 3/0233* (2013.01); *F25J 3/0242* (2013.01); *F25J 2200/78* (2013.01); *C10G 5/06* (2013.01); *C10G 2300/4056* (2013.01); *F25J 2205/04* (2013.01); *F25J 3/0209* (2013.01); *F25J 2245/02* (2013.01); *C10L 3/12* (2013.01); *F25J 2200/74* (2013.01); *F25J 2200/04* (2013.01); *F25J 2280/02* (2013.01); *C10G 5/04* (2013.01); *F25J 2240/02* (2013.01)

USPC ..... 62/631; 62/618; 62/620; 62/628; 62/630

(58) Field of Classification Search

CPC ..... F25J 3/0209; F25J 3/0233; F25J 3/0238; F25J 3/0242; F25J 3/0295; F25J 2290/80; F25J 2200/04; F25J 2200/70–2200/78; F25J 2205/04; F25J 2245/02; F25J 2280/02; F25J 2210/05

USPC ..... 62/618, 620, 621, 623, 628, 630, 631, 62/657

See application file for complete search history.

(56) References Cited

U.S. PATENT DOCUMENTS

| | | | |
|---|---|---|---|
| 4,278,457 | A | 7/1981 | Campbell |
| 4,509,967 | A | 4/1985 | Sweet |

(Continued)

FOREIGN PATENT DOCUMENTS

| | | |
|---|---|---|
| WO | 2005045338 | 5/2005 |
| WO | 2007014069 | 2/2007 |

OTHER PUBLICATIONS

Patent Cooperation Treaty, "Notification of Transmittal of the International Search Report and the Written Opinion of the International Searching Authority, or the Declaration", PCT Application No. PCT/US12/43332, issued Jan. 21, 2013.

*Primary Examiner* — Mohammad M Ali
*Assistant Examiner* — Keith Raymond
(74) *Attorney, Agent, or Firm* — Fish & Tsang, LLP

(57) ABSTRACT

Devices and methods for retrofitting a natural gas liquids plant are contemplated to extend recovery of C3+ hydrocarbons from various feed gases to recovery of C2+ and C3+ hydrocarbons. In especially preferred aspects, dedicated C2+ exchangers are integrated to exclusively cool the feed gas to produce a cooled absorber feed and to produce two separate absorber reflux streams. During C2+ recovery, absorber reflux is provided by a portion of the residue gas and a portion of the feed gas, while during C3+ recovery absorber and distillation column reflux are provided by the distillation column overhead product.

9 Claims, 2 Drawing Sheets

(56) References Cited

U.S. PATENT DOCUMENTS

| | | | | |
|---|---|---|---|---|
| 4,854,955 | A | 8/1989 | Campbell | |
| 5,890,377 | A | 4/1999 | Foglietta | |
| 5,890,378 | A | 4/1999 | Rambo | |
| 5,953,935 | A | 9/1999 | Sorensen | |
| 6,116,050 | A * | 9/2000 | Yao et al. | 62/630 |
| 6,244,070 | B1 | 6/2001 | Elliott et al. | |
| 6,354,105 | B1 | 3/2002 | Lee | |
| 6,823,692 | B1 * | 11/2004 | Patel et al. | 62/620 |
| 7,051,553 | B2 * | 5/2006 | Mak et al. | 62/636 |
| 2004/0261452 | A1 | 12/2004 | Mak et al. | |
| 2007/0240450 | A1 * | 10/2007 | Mak | 62/626 |
| 2010/0206003 | A1 * | 8/2010 | Mak | 62/630 |
| 2012/0085127 | A1 * | 4/2012 | Nanda et al. | 62/623 |

* cited by examiner

CONFIGURATIONS AND METHODS FOR RETROFITTING AN NGL RECOVERY PLANT

This application claims priority to our U.S. provisional patent application with the Ser. No. 61/499,033, which was filed 20 Jun. 2011, which is incorporated by reference herein.

FIELD OF INVENTION

The field of invention is processing natural gas, especially as it relates to retrofitting of a natural gas liquid (NGL) plant from propane recovery to ethane recovery operation.

BACKGROUND OF THE INVENTION

Most natural gas plants are designed to condition the feed gas to meet pipeline sales gas specification (e.g., requiring specific hydrocarbons dew point and water content), which is typically achieved by extracting propane plus components. The main revenue from the gas plant operation is generated from sales of the condensate components, which are mainly propane, butanes, and heavier hydrocarbons. Hence, most of the plants are configured to maximize propane recovery. In the past, the ethane content in the feed gas was valued only for its heating content, and there were no significant incentives for ethane recovery. However, with increasing demand from petrochemical facilities to use ethane as a feedstock, ethane can be sold at a premium. Gas plants that were designed for the traditional propane recovery are now considering recovering ethane operation. However, retrofitting an existing facility to produce an ethane product is generally difficult and costly.

Numerous separation processes and configurations are known in the art to fractionate the NGL fractions from natural gas. In a typical gas separation process, a high pressure feed gas stream is cooled by heat exchangers, in most cases using propane refrigeration and turbo expansion, with the extent of cooling depending on the richness of the feed gas and desired level of recoveries. As the feed gas is cooled under pressure, the hydrocarbon liquids are condensed and separated from the cooled gas. The liquid is then expanded and fractionated in a distillation column (e.g., deethanizer or demethanizer) to separate the lighter components such as methane, nitrogen and other light components as an overhead vapor from the NGL bottom products.

For example, Rambo et al. describe in U.S. Pat. No. 5,890,378 a system in which the absorber is refluxed, in which the deethanizer condenser provides refluxes for both the absorber and the deethanizer while the cooling duties are supplied by turbo-expansion and propane refrigeration. Here, the absorber and the deethanizer operate at essentially the same pressure. Although Rambo's configuration can often efficiently recover 98% of the C3+ hydrocarbons by additional equipment to generate refluxes, high ethane recovery (e.g. over 80%) becomes difficult, especially when the feed gas pressure is low (e.g., less than 600 psig). High ethane recovery typically requires lowering the absorber pressure, which in turn increases the recompression horsepower requirement. Unfortunately, the lower pressure also increases the $CO_2$ freezing temperature in the demethanizer, particularly when the feed gas contains a significant amount of $CO_2$.

To circumvent at least some of the problems associated with relatively low efficiency and recoveries, Sorensen describes in U.S. Pat. No. 5,953,935 a plant configuration in which the absorber reflux is produced by cooling and Joule-Thomson expansion of a slipstream of feed gas in addition to expansion of another portion of the feed gas. Although Sorensen's configuration may achieve high ethane recoveries, it may only be applicable to very lean gases, while requiring the demethanizer column to operate at a very low pressure, which once more requires additional residue gas recompression horsepower.

In yet other known configurations, high NGL recoveries were attempted with various improved fractionation and reflux configurations. Typical examples are shown in U.S. Pat. No. 4,278,457, and U.S. Pat. No. 4,854,955, to Campbell et al., in U.S. Pat. No. 6,244,070 to Elliott et al., and in U.S. Pat. No. 5,890,377 to Foglietta. While such configurations may provide at least some advantages over prior processes, they are generally intended to operate on a fixed recovery mode, either ethane recovery or propane recovery. Moreover, most of such known configurations require extensive modifications of turbo expanders and changes in operating conditions when the plants are changed from propane recovery to ethane recovery or vice versa. In most instances, ethane recovery is limited to 20% to 40% while higher ethane recovery would require excessive recompression horsepower and would result in a lower propane recovery.

To circumvent at least some of the problems associated with high ethane recovery while maintaining a high propane recovery, a twin reflux process (described in U.S. Pat. No. 7,051,553 to Mak et al.) employs configurations in which a first column receives two reflux streams: one reflux stream comprising a vapor portion of the NGL and the other reflux stream comprising a lean reflux provided by the overhead of the second distillation column. Similarly, U.S. Pat. App. No. 2010/0206003 to Mak et al. describes an improved natural gas liquid recovery method in which residue gas is integrated to the propane recovery design such that it can be used to reflux the demethanizer during high ethane recovery. While these processes can be operated on either propane recovery or ethane recovery, the configurations are generally suitable only for grass root installation and not for retrofit. Moreover, very high ethane recovery (e.g., over 90%) is still not feasible nor economical using such methods. All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Thus, although various configurations and methods are known to recover natural gas liquids, all or almost all of them suffer from one or more disadvantages. For example, while some known methods and configurations can be employed for both propane recovery and ethane recovery, the capital and operating costs for such plants can be very high and may not be justifiable. On the other hand, retrofitting an existing propane recovery plant for ethane recovery requires significantly less investment. However, retrofitting requires an entirely different approach on plant configuration and operation. Therefore, there is a need to provide methods and configurations for retrofitting a propane recovery plant for ethane recovery, especially where high ethane recovery over 90% is desired.

SUMMARY OF THE INVENTION

The present invention is directed to methods and kits for retrofitting a two-column NGL recovery plant NGL in which the absorber receives alternate reflux streams that are provided by dedicated heat exchangers. For C3+ recovery (i.e., recovery of propane and higher hydrocarbons), the reflux is an overhead liquid from the distillation column, and for C2+ recovery (i.e., recovery of ethane and higher hydrocarbons), two separate reflux streams are fed to the absorber, with the first reflux stream being formed from a portion of the residue gas and the second reflux stream being formed from a portion of the feed gas. In especially preferred aspects, retrofitted plants allow C2 recovery of at least 90% and C3+ recovery of at least 99%, with the flexibility of varying C2 recovery from 2% to 98% while maintaining 99% or higher C3+ recovery.

Contemplated plants, kits, and methods are particularly suitable for retrofitting an existing C3+ recovery plant to allow for high C2 recovery while preserving the original C3+ recovery plant components and operational scheme. Thus, it should be recognized that contemplated plants and methods can be used to reject C2 when only C3+ recovery is required, and that the change of operation may be automated by programmable switching valves.

In one aspect of the inventive subject matter a method of retrofitting a natural gas liquids plant for recovery of C2+ hydrocarbons is contemplated where the NGL plant has an absorber, a downstream distillation column, and a C3+ recovery exchanger that is configured to a cool feed gas and to cool an overhead product from the distillation column to thereby form a reflux stream for the absorber, and wherein a bottom product of the absorber is fed to the downstream distillation column. In such methods, it is particularly preferred that a bypass circuit for the C3+ recovery exchanger is installed that includes first and second dedicated C2+ recovery exchangers. Most typically, the first C2+ recovery exchanger uses refrigeration content from an absorber overhead product to produce an ultra-lean reflux stream from a portion of compressed residue gas and a reflux stream from a portion of the feed gas, and the second C2+ recovery exchanger uses refrigeration content from the absorber bottom product to produce a cooled feed gas from another portion of the feed gas. In another step, a bypass is installed that routes the overhead product from the distillation column to the absorber as a stripping vapor.

In still further preferred aspects of such contemplated methods, a conduit is installed that provides a liquid portion of the cooled feed gas to the absorber, and/or a control circuit is installed that controls operation of switching valves to fluidly bypass the C3+ recovery exchanger when C2+ recovery is desired. It is still further generally preferred that an overhead condenser of the distillation column is used to produce the cooled feed gas. Likewise, it is preferred that a vapor portion of the cooled feed gas is expanded to absorber pressure prior to feeding the vapor portion into the absorber.

Therefore, viewed from a different perspective, methods and kits are contemplated for retrofitting a natural gas liquids plant for recovery of C2+ hydrocarbons. In such methods, the natural gas liquids plant has an absorber, a downstream distillation column, and a C3+ recovery exchanger that is configured to a cool feed gas and to cool an overhead product from the distillation column to thereby form a reflux stream for the absorber, and wherein a bottom product of the absorber is fed to the downstream distillation column.

In particularly preferred methods, first and second dedicated C2+ recovery exchangers, piping, and a plurality of switching valves are installed such that (a) the flow of the feed gas is routable exclusively to the C3+ recovery exchanger or the first and second C2+ recovery exchangers, wherein the C3+ recovery exchanger is configured to produce a cooled feed gas from the feed gas, wherein the first C2+ recovery exchanger is configured to produce a feed gas reflux stream from a first portion of the feed gas, and wherein the second C2+ recovery exchanger is configured to produce a cooled feed gas from a second portion of the feed gas; (b) the flow of the bottom product of the absorber is routable exclusively to the C3+ recovery exchanger or the second C2+ recovery exchanger to provide refrigeration content to the C3+ recovery exchanger or the second C2+ recovery exchanger; (c) the flow of an overhead product of the absorber is routable exclusively to the first C2+ recovery exchanger to provide refrigeration content to generate for the absorber an ultra-lean reflux stream from a portion of compressed residue gas; and (d) flow of an overhead product of the distillation column is routable exclusively to the absorber as a stripping vapor, or to the absorber as the reflux stream for the absorber and the distillation column as a distillation column reflux.

In further especially preferred aspects, at least one of the switching valves is a three-way valve, and it is still further generally preferred that a control circuit is installed that controls operation of the switching valves to bypass the C3+ recovery exchanger when C2+ recovery is desired. While not limiting to the inventive subject matter, it is also preferred that an overhead condenser of the distillation column is fluidly coupled with the second C2+ recovery exchanger to produce the cooled feed gas from the second portion of the feed gas.

Various objects, features, aspects and advantages of the present invention will become more apparent from the following detailed description of preferred embodiments of the invention.

DETAILED DESCRIPTION

The inventor has discovered that a two-column NGL recovery plant (i.e., a plant with an absorber and fluidly coupled downstream distillation column) can be retrofitted such that C3+ recovery from a feed gas can be extended to C2+ recovery in a conceptually simple and effective manner. In especially preferred methods and systems, the plant is modified such that the absorber receives alternate reflux streams from dedicated heat exchangers and using different sources for the reflux streams.

For C3+ recovery (i.e., recovery of propane and higher hydrocarbons), the reflux is an overhead liquid from the distillation column, and for C2+ recovery (i.e., recovery of ethane and higher hydrocarbons), two separate reflux streams are fed to the absorber, with the first reflux stream being formed from a portion of the residue gas and the second reflux stream being formed from a portion of the feed gas. In especially preferred aspects, retrofitted plants allow C2 recovery of at least 90% and C3+ recovery of at least 99%, with the flexibility of varying C2 recovery from 2% to 98% while maintaining 99% or higher C3+ recovery. Viewed from another perspective, plants and methods using recovery exchangers dedicated to C2+ recovery and C3+ recovery will achieve over 90% ethane recovery while maintaining 99.5% propane recovery during C2+ recovery operation, and will achieving the same propane recovery during C3+ recovery (C2 rejection) operation.

Especially contemplated recovery exchangers include a C2+ recovery exchanger that is configured to produce chilled reflux streams from residue gas and a portion of the feed gas, and the C3+ recovery exchanger is configured to form reflux from the second fractionation (distillation) column. As contemplated systems and methods do not any require substantial modification of the existing C3+ recovery plant, retrofitting is especially simple while maintaining the desired C3+ recovery of an existing plant. It should be further recognized that contemplated plants and methods can be used to reject C2 when only C3+ recovery is required, and the change of operation is most preferably automated using programmable switching valves and an associated control circuit that controls operation of switching valves to fluidly bypass the C3+ recovery exchanger when C2+ recovery is desired and to fluidly bypass the C2+ recovery exchanger when C3+ recovery is desired.

Figure 1:
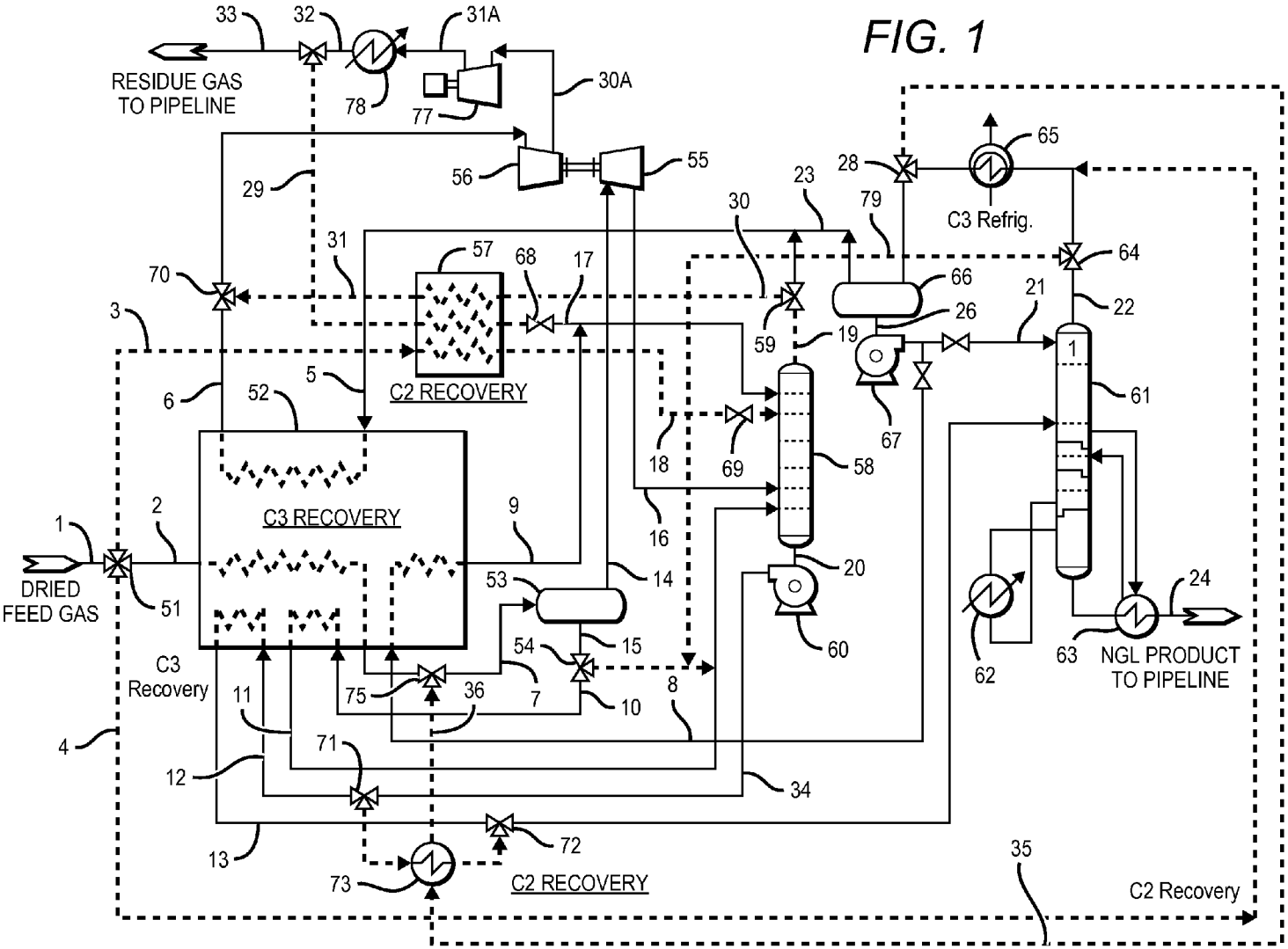
FIG. 1 is a schematic diagram of one exemplary propane recovery plant retrofitted for ethane recovery according to the inventive subject matter.

In one exemplary configuration as depicted in FIG. 1, an NGL recovery plant has a first column (absorber) 58 that is fluidly coupled to a second column (distillation column) 61. The plant was originally designed for C3+ recovery with a high nitrogen content natural gas feed containing 18 mole % N2, 64 mole % C1, 11 mole % C2, 5 mole % C3, 2 mole % C4 and the balance C5+ hydrocarbons and is supplied at a temperature of about 100° F. and a pressure of about 930 psig. As used herein, the term "about" in conjunction with a numeral refers to that numeral +/−10, inclusive. For example, where a temperature is "about 100° F.", a temperature range of 90-110° F., inclusive, is contemplated.

The following describes the C3+ recovery or C2 rejection mode of operation in FIG. 1. Here, the feed gas inlet valve 51 is configured to exclusively route the feed gas 1 to either the C3+ recovery exchanger 52 or the C2+ recovery exchanger 57. During C3+ recovery, the valve is opened to the exchanger 52 and closed to exchanger 57 and 65. The feed gas stream 2 is chilled by exchanger 52 to about −35° F. by residue gas stream 5, separator liquid stream 10 and demethanizer bottom stream 12. The two phase stream 7 is flashed to separator 53 forming vapor stream 14 and liquid stream 15. The liquid stream 15 is letdown in pressure to about 400 psig via valve 54 and chilled to a temperature of about −60° F. The chilled stream is sent to exchanger 52 as stream 10 and heated to about 20° F., forming stream 11 prior to flashing to the bottom of demethanizer 58. The vapor stream 14 is expanded in expander 55 to about 370 psig and chilled to about −100° F., forming stream 16 and enters the lower section of the absorber at least two trays from the column bottom. The power produced from the expander is used to drive re-compressor 56.

During C3+ recovery operation, demethanizer 58 is refluxed with C2 rich liquid from the overhead liquid from the second distillation column, stream 9. The demethanizer 58 produces an overhead vapor stream 19 at about −100° F. and about 355 psig and a bottom liquid stream 20 at about −20° F. The overhead vapor is combined with the reflux drum vapor stream 23 forming stream 5 at about −95° F. The combined stream is heated by the feed gas stream to about 40° F., forming stream 6 which is compressed by re-compressor 56 to about 440 psig, forming stream 30A. The residue gas is further compressed by residue gas compressor 77 to about 1145 psig forming stream 31A, which is cooled by cooling water in exchanger 78 forming stream 32. The residue gas is sent directly to the sales gas pipeline as stream 33 at a temperature of about 100° F. and a pressure of about 1150 psig.

The demethanizer bottom stream 20 is pumped by pump 60 to about 375 psig forming stream 34 and heated in exchanger 52. The two phase stream 13 is routed to the mid section of the deethanizer 61. The deethanizer produces an overhead vapor 22 which is cooled by propane refrigeration in exchanger 65 to about −35° F. The two phase stream is then routed through valve 28 as stream 25 and separated in reflux drum 66 producing vapor stream 23 and liquid stream 26. The vapor stream is routed to combine with absorber overhead stream 19 and the liquid stream is pumped by pump 67 to about 490 psig and then split into two portions. About 70% is used as reflux to the deethanizer as stream 21, and the remaining portion, stream 8 is used as reflux to the demethanizer. The liquid in the deethanizer is stripped by reboiler 62 and side reboiler 63, producing the C3+ bottom product stream 24 with the required ethane to propane specification. A typical overall balance for the C3 operation is shown in the following table.

TABLE 1

C3+ Recovery Balance

| | Feed Gas | C3+ | Residue Gas |
|---|---|---|---|
| Methane | 0.6409 | 0.0000 | 0.6931 |
| Ethane | 0.1105 | 0.0100 | 0.1171 |
| Propane | 0.0465 | 0.6176 | 0.0000 |
| i-Butane | 0.0049 | 0.0651 | 0.0000 |
| n-Butane | 0.0122 | 0.1521 | 0.0000 |
| i-Pentane | 0.0023 | 0.0596 | 0.0000 |
| n-Pentane | 0.0027 | 0.0359 | 0.0000 |
| n-Hexane | 0.0045 | 0.0598 | 0.0000 |
| N2 | 0.1750 | 0.0000 | 0.1892 |
| Temperature, F. | 117 | 92 | 104 |
| Pressure, psia | 953 | 764 | 1,170 |

The C3+ recovery plant can be retrofitted to allow for C2+ recovery and the required changes are shown in FIG. 1 using dashed lines. Here, during C2+ recovery operation, the deethanizer is changed to demethanizer operation producing a C2+ liquid bottom. Dedicated C2+ recovery exchanger 57 is added that provide feed gas reflux and residue gas reflux to the absorber, and exchanger 52 is bypassed. The following describes C2+ recovery operation in more detail.

The feed gas is split into two portions using valve 51, stream 3, about 70% of the feed gas is routed to exchanger 57, and the remaining portion, stream 4, is routed to propane chiller 65. Stream 3 is chilled to about −170° F. in recovery exchanger 57 forming stream 18, which is reduced in pressure via JT valve 69, and which is routed to the demethanizer as a second reflux. The top reflux (1st tray reflux) is provided by recycling about 10% to 20% of the residue gas (via stream 29) after the residue is chilled and is subcooled in exchanger 57, and reduced in pressure via JT valve 68, forming reflux stream 17. Stream 4 is cooled by propane refrigeration to about −15° F. forming stream 35, is routed via valve 28 and further cooled in exchanger 73 by heat exchange with the absorber bottom stream 34 to so form stream 36. Thus, especially preferred plants and methods will include a first (57) and second (73) C2+ exchanger. So cooled feed gas stream portion 36 is then routed via valve 75 to separator 53. Valve 71 and valve 72 are operated such that stream 34 bypasses exchanger 52, is heated to about −36° F. in exchanger 73 prior to routing to the second column 61. Column 61 acts as a demethanizer producing an overheads vapor 22 and a C2+ product 24. Valve 64 is operated such that stream 22 is re-routed to the bottom of the absorber column 58 as stream 79. It should be noted that during the C2 recovery, stream 79 acts as a stripping gas to remove the C1 and lighter components in the absorber bottom, which results in the production of a C2+ product with very low C1 content, as low as 0.0001 volume fraction in the C2+ product. During C2+ recovery operation, liquid from separator 53 stream 15 is routed directly to the absorber bottom and vapor stream 14 is expanded in expander 55 to about 370 psig and about −100° F. and them flashed to a lower section of the absorber, in a manner similar to the C3+ recovery operation.

The absorber column 58 produces an overhead stream 19 at about −160° F. and about 365 psig and a bottom liquid stream 20 at about −60° F. The overhead vapor is re-routed via valve 59 as stream 30 to the C2+ recovery exchanger 57, and is heated to about 65° F. forming stream 31, which is routed through valve 70 for compression by re-compressor 56 and residue gas compressor 77. The high pressure residue gas is cooled in cooler 78 and about 10% to 20% is recycled back to the absorber as reflux, and the balance is sent to the sales gas pipeline. The overall balance for this operation is shown in the following table.

TABLE 2

C2+ Recovery Balance

| | Feed Gas | C2+ | Residue Gas |
|---|---|---|---|
| Methane | 0.6395 | 0.0002 | 0.7826 |
| Ethane | 0.1103 | 0.5947 | 0.0034 |
| Propane | 0.0464 | 0.2566 | 0.0000 |
| i-Butane | 0.0049 | 0.0271 | 0.0000 |
| n-Butane | 0.0122 | 0.0674 | 0.0000 |
| i-Pentane | 0.0023 | 0.0127 | 0.0000 |
| n-Pentane | 0.0027 | 0.0149 | 0.0000 |
| n-Hexane | 0.0045 | 0.0249 | 0.0000 |
| N2 | 0.1746 | 0.0000 | 0.2137 |
| Temperature, ° F. | 117 | 75 | 104 |
| Pressure, psia | 953 | 805 | 1,165 |

Figure 2:
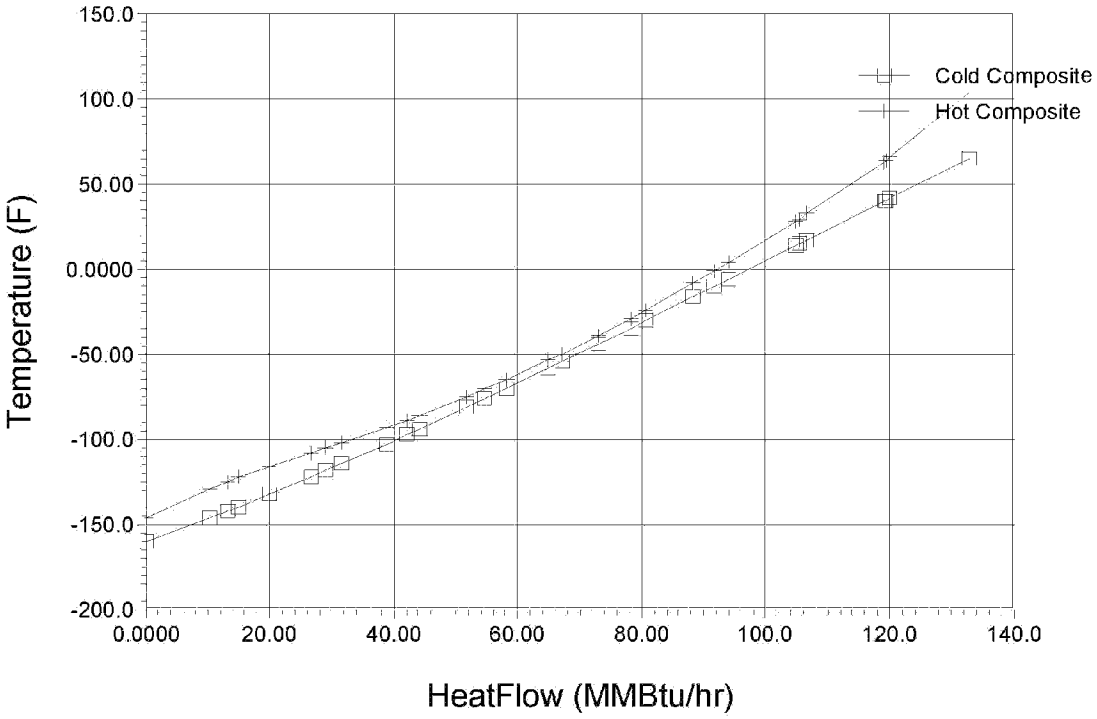
FIG. 2 is a composite heat curve for ethane recovery exchanger (57) of FIG. 1 during ethane recovery operation according to the inventive subject matter.

Thus, it should be recognized that the first column (absorber) overhead vapor cools the residue gas which provides the top reflux (ultra lean) and also cools a portion of the feed gas as the second reflux that results in high C2 recovery of 98%. Moreover, operation may also be switched to C3+ recovery (C2 rejection) by switching reflux from the overhead of the second column. In a preferred aspect, switching between ethane recovery and propane recovery can be operated by valve positioning to the routing as shown in FIG. 1. The valves can be configured as a multi-port valves, such as three-way valves, or alternatively with two or three separate valves dedicated to the operations. The valve switching can be programmed and can be operated automatically to ensure a smooth transition between operations. Furthermore, while it is generally preferred that the switching is performed in an exclusive manner (i.e., either routed to one destination or another), non-exclusive switching is also contemplated herein. Contemplated configurations and methods result in high C2 recovery of 98% with low energy consumption as exemplified by the close approaches demonstrated in the heat composite curve of the C2+ recovery exchanger 57 in FIG. 2.

With respect to suitable feed gas streams, it is contemplated that various feed gas streams are appropriate, and especially suitable fed gas streams may include various hydrocarbons of different molecular weight. With respect to the molecular weight of contemplated hydrocarbons, it is generally preferred that the feed gas stream predominantly includes C1-C6 hydrocarbons, and contains high percentage of nitrogen. However, suitable feed gas streams may additionally comprise acid gases and other gaseous components (e.g., hydrogen). Consequently, particularly preferred feed gas streams are natural gas and natural gas liquids.

Most preferably, contemplated plants and methods will employ a two-column NGL recovery plant configuration with an absorber and a distillation column, wherein the absorber is configured to receive alternate reflux streams that allow C3+ recovery to be operated by a reflux stream from an overhead liquid from the distillation column and the C2+ recovery to be operated with two reflux streams from the residue gas and from at least a portion of the feed gas. Such plants allow C2 recovery of at least 90% and C3+ recovery of at least 99% with the flexibility of varying C2 recovery from 2% to 98% while maintaining 99% or higher C3+ recovery. Viewed from another perspective, it should be recognized that contemplated methods and configurations include a first and a second column, utilize high pressure residue gas recycle to provide an ultra-lean reflux as the first reflux and at least a portion of the chilled feed gas as a second reflux for C2+ recovery, and the alternate reflux comprising the overhead liquid from the distillation column for C3+ recovery, while at least a portion of the chilled feed gas is expanded to the absorber for all operations.

Contemplated configurations are especially advantageous in retrofitting an existing C3+ recovery plant for C2+ recovery, by the addition of a C2+ recovery exchanger, which is more economical than a new plant designed for both C2+ and C3+ recovery. Such configuration also simplifies plant operation using switching valves dedicated for the recovery operation. Thus, it should be especially recognized that in the configurations and methods presented herein, the cooling requirements for the first column are at least partially provided by intermediate product streams, residue gas recycle, propane refrigeration and turbo expansion, and that the C2 recovery level can be varied by varying the residue recycle flow rate from 0% to 20%. With respect to the C2 recovery, it is contemplated that such configurations provide at least 90%, more typically at least 94%, and most typically at least 96%, while it is contemplated that C3+ recovery will be at least 95%, more typically at least 98%, and most typically at least 99%. Further related configurations, contemplations, and methods are described in our U.S. application 2010/0206003 and International patent applications with the publication numbers WO 2005/045338 and WO 2007/014069, all of which are incorporated by reference herein.

Thus, specific embodiments and applications for improved natural gas liquids recovery have been disclosed. It should be apparent, however, to those skilled in the art that many more modifications besides those already described are possible without departing from the inventive concepts herein. The inventive subject matter, therefore, is not to be restricted except in the spirit of the present disclosure. Moreover, in interpreting the specification and contemplated claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein is inconsistent or contrary to the definition of that term provided herein, the definition of that term provided herein applies and the definition of that term in the reference does not apply.

What is claimed is:

1. A method of retrofitting a natural gas liquids plant for recovery of C2+ hydrocarbons, wherein the natural gas liquids plant has an absorber, a downstream distillation column, and a C3+ recovery exchanger that is configured to cool a feed gas and to cool an overhead product from the distillation column to thereby form a reflux stream for the absorber, and wherein a bottom product of the absorber is fed to the downstream distillation column, comprising:

installing a bypass circuit for the C3+ recovery exchanger that includes first and second dedicated C2+ recovery exchangers;

wherein the first C2+ recovery exchanger uses refrigeration content from an absorber overhead product to produce an ultra-lean reflux stream from a portion of compressed residue gas and a reflux stream from a portion of the feed gas;

wherein the second C2+ recovery exchanger uses refrigeration content from the absorber bottom product to produce a cooled feed gas from another portion of the feed gas; and installing a bypass that routes the overhead product from the distillation column to the absorber as a stripping vapor.

2. The method of claim 1 further comprising a step of installing a conduit that provides a liquid portion of the cooled feed gas to the absorber.

3. The method of claim 1 further comprising a step of installing a control circuit that controls operation of switching valves to fluidly bypass the C3+ recovery exchanger when C2+ recovery is desired.

4. The method of claim 1 further comprising a step of using an overhead condenser of the distillation column to produce the cooled feed gas.

5. The method of claim 1 wherein a vapor portion of the cooled feed gas is expanded to absorber pressure prior to feeding the vapor portion into the absorber.

6. A method of retrofitting a natural gas liquids plant for recovery of C2+ hydrocarbons, wherein the natural gas liquids plant has an absorber, a downstream distillation column, and a C3+ recovery exchanger that is configured to cool a feed gas and to cool an overhead product from the distillation column to thereby form a reflux stream for the absorber, and wherein a bottom product of the absorber is fed to the downstream distillation column, comprising:

installing first and second dedicated C2+ recovery exchangers, piping, and a plurality of switching valves such that:

(a) flow of the feed gas is routable exclusively to the C3+ recovery exchanger or the first and second C2+ recovery exchangers;

wherein the C3+ recovery exchanger is configured to produce a cooled feed gas from the feed gas, wherein the first C2+ recovery exchanger is configured to produce a feed gas reflux stream from a first portion of the feed gas, and wherein the second C2+ recovery exchanger is configured to produce a cooled feed gas from a second portion of the feed gas;

(b) flow of the bottom product of the absorber is routable exclusively to the C3+ recovery exchanger or the second C2+ recovery exchanger to provide refrigeration content to the C3+ recovery exchanger or the second C2+ recovery exchanger;

(c) flow of an overhead product of the absorber is routable exclusively to the first C2+ recovery exchanger to provide refrigeration content to generate for the absorber an ultra-lean reflux stream from a portion of compressed residue gas; and (d) flow of an overhead product of the distillation column is routable exclusively to the absorber as a stripping vapor, or to the absorber as the reflux stream for the absorber and the distillation column as a distillation column reflux.

7. The method of claim 1 wherein at least one of the switching valves is a three-way valve.

8. The method of claim 1 further comprising a step of installing a control circuit that controls operation of the switching valves to bypass the C3+ recovery exchanger when C2+ recovery is desired.

9. The method of claim 1 further comprising a step of fluidly coupling an overhead condenser of the distillation column with the second C2+ recovery exchanger to produce the cooled feed gas from the second portion of the feed gas.

* * * * *